US007748447B2

(12) United States Patent
Moore

(10) Patent No.: US 7,748,447 B2
(45) Date of Patent: Jul. 6, 2010

(54) TORQUE ANCHOR AND METHOD FOR USING SAME

(75) Inventor: Edward L. Moore, Calgary (CA)

(73) Assignee: Tazco Holdings Inc. (CA)

( * ) Notice: Subject to any disclaimer, the term of this patent is extended or adjusted under 35 U.S.C. 154(b) by 145 days.

(21) Appl. No.: 12/068,954

(22) Filed: Feb. 13, 2008

(65) Prior Publication Data

US 2009/0126926 A1 May 21, 2009

(30) Foreign Application Priority Data

Nov. 16, 2007 (CA) ..... 2611294

(51) Int. Cl.
*E21B 43/00* (2006.01)

(52) U.S. Cl. ..... 166/243; 166/117.7; 166/241.7

(58) Field of Classification Search ..... 166/117.7, 166/243, 241.7, 241.6, 242.3, 217, 206
See application file for complete search history.

(56) References Cited

U.S. PATENT DOCUMENTS

| | | | | |
|---|---|---|---|---|
| 3,940,832 | A | 3/1976 | Kelly et al. | |
| 4,811,785 | A | 3/1989 | Weber | |
| 4,901,793 | A * | 2/1990 | Weber | 166/68.5 |
| 5,180,014 | A | 1/1993 | Cox | |
| 5,636,690 | A * | 6/1997 | Garay | 166/216 |
| 5,954,136 | A | 9/1999 | McHugh et al. | |
| 6,189,610 | B1 * | 2/2001 | LaClare et al. | 166/208 |
| 6,968,897 | B2 * | 11/2005 | Doyle et al. | 166/214 |
| 7,278,478 | B2 * | 10/2007 | LaClare et al. | 166/210 |

FOREIGN PATENT DOCUMENTS

| | | |
|---|---|---|
| CA | 1274470 | 9/1990 |
| CA | 2159659 | 4/1997 |
| CA | 2238910 | 5/1998 |
| CA | 2220392 | 5/1999 |

OTHER PUBLICATIONS

Drawing marked Exhibit H [1 page] from Advantage Products Inc., schematic cross-sectional view of a TS-8 model, date unknown.
Office action dated Feb. 5, 2009 from Canadian Intellectual Property Office (CIPO) for Canadian Patent Application No. 2,611,294.
Office action dated Sep. 25, 2009 from Canadian Intellectual Property Office (CIPO) for Canadian Patent Application No. 2,611,294.

(Continued)

*Primary Examiner*—Daniel P Stephenson
*Assistant Examiner*—Kipp C Wallace
(74) *Attorney, Agent, or Firm*—Davidson Berquist Jackson & Gowdey, LLP; Brian Siritzky

(57) ABSTRACT

A torque anchor for use with progressive cavity pumps (PC Pumps) for preventing rotation of the PC Pumps and any related tool string within a well bore, possessing a connector constructed and adapted to connect a tube, which in a preferred embodiment is a diluent cable, between the two fixed slips. A method is also recited for running coiled tubing or a diluent cable downhole using the torque anchor.

27 Claims, 6 Drawing Sheets

OTHER PUBLICATIONS

Response by applicant (Tazco) to Office Action filed Aug. 5, 2009 in Canadian Intellectual Property Office (CIPO) for Canadian Patent Application No. 2,611,294 in response to office action dated Feb. 5, 2009.

Response by applicant (Tazco) to Office Action filed Oct. 7, 2009 in Canadian Intellectual Property Office (CIPO) for Canadian Patent Application No. 2,611,294 in response to office action dated Sep. 25,2009.

Aponte, H. et al., "Experiences Using an ESP Application on heavy-Oil Cold-Production Automation in Eastern Venezuela Fields," Mar. 2001, Society of Petroleum Engineers, SPE 69708.

Brochure Dated Mar. 25, 2004, Printed Publications from Internet Archive updated Mar. 12, 2006 (archive.org search for www.advantageproductsinc.com (Cited in Protest to CA 2,611,294, filed Apr. 8, 2010 in Canadian Intellectual Property Office)).

Canadian Oil & Gas Review Nov. 2003, pp. F3-F4 and supporting Invoice from MOHR Advertising for the advertisement (Cited in Protest to CA 2,611,294, filed Apr. 8, 2010 in Canadian Intellectual Property Office).

Canadian Oil and Gas Review, May 2005, pp. A17-A18 and supporting Invoice from JuneWarren Publishing company for the advertisement. (Cited in Protest to CA 2,611,294, filed Apr. 8, 2010 in Canadian Intellectual Property Office).

Protest to CA 2,611,294, filed Apr. 8, 2010 in Canadian Intellectual Property Office [18 pgs.].

Ramirez, et al, Multilateral Field Experience in Developing an Extra Heavy Crude-Oil Reservoir, (Mar. 14-16, 2004), Society of Petroleum Engineers, SPE 86947.

Robles, J., "Applications of Advanced Heavy-Oil-Production Technologies in the Orinoco Heavy-Oil-Belt, Venezuela," Mar. 2001, Society of Petroleum Engineers, SPE 69848.

* cited by examiner

TORQUE ANCHOR AND METHOD FOR USING SAME

FIELD OF THE INVENTION

The invention describes a torque anchor for use with progressive cavity pumps (PC pumps) for preventing rotation of the PC pumps and any related tool string and tubing within a wellbore. The torque anchor includes at least one fixed rigid slip and one pivotable slip that in combination enhance the ability of the torque anchor to remain centered within wellbore casing and provide space between the torque anchor and wellbore casing for other tubing and/or other cabling or instruments to be run within the well and/or facilitate the passage of sand and other substances indigenous to many well formations past the torque anchor.

BACKGROUND OF THE INVENTION

During oil-well production, in-line pumps such as progressive cavity pumps are used to pump oil from the well bore to the surface. A progressive cavity pump system includes a surface driven rotor mounted within a downhole stator that is rotationally secured to production casing so as to prevent rotation of the stator in response to the rotation of the rotor. The stator is secured to the production tubing by a torque anchor that permits the stator to be positioned in the well at a desired location wherein upon clockwise rotation of the tubing string and connected tool string, the torque anchor will lock against the wellbore casing and thereby secure the stator to prevent right-hand rotation of the tubing string within the well casing so as to enable operation of the progressive cavity pump.

Within a wellbore, it is often desired that in addition to enabling the operation of the progressive cavity pump, that one or more lengths of coiled tubing and/or cabling also be run within the wellbore to regions below the pump for various purposes such as to deliver hot oil or diluent to break up sand or heavy oil within the formation and/or to communicate with one or more instruments beneath the progressive cavity pump. That is, as operators seek to collect more information from a well during production and/or seek to concurrently perform other operations within the well using additional systems, auxiliary lengths of coiled tubing or cable may be run past the torque anchor.

In addition, in deviated wells in particular, it is desirable to maintain the progressive cavity pump in a centralized position to enable coiled tubing and/or cable to be readily run past the progressive cavity pump without binding or wedging of this auxiliary tubing or cabling between the torque anchor and casing or wellbore.

As a result, there has been a need for a torque anchor that, in addition to performing as an effective torque anchor, improves the ability of the operator to perform other operations within the well. Further, as progressive cavity pumps are often used in wells containing sand or other heavy substances it is desirable for the torque anchor to utilize a housing with as much flow-through space as possible, achievable by utilizing a housing with a smaller diameter and relatively larger slips.

A review of the prior art indicates that a number of different anti-rotation systems have been developed in the past that utilize a variety of concepts to provide different functionalities to an anti-rotation system or torque anchor.

For example, Advantage Products Inc. (Calgary, Alberta) produces a torque anchor that utilizes a single pivotable slip for deployment against well casing. In this system, the single slip extends from the main body of the torque anchor upon clockwise rotation of the tubing string such that when the slip engages with the well casing, the main body of the torque anchor is forced to move across the casing to the opposite side of the casing. This system can provide a pinch point that can damage tubing running adjacent to the torque anchor. In addition, this system by virtue of the main body of the torque anchor engaging with the well casing will similarly cause tools such as the stator of a PC pump to be biased against the well casing causing extra wear on such tools.

Canadian Patent 2,159,659 and U.S. Pat. No. 5,636,690 describe a torque anchor having pivotable slips for engagement with the well casing. In a horizontal and some deviated operations which make up a significant portion of all applications, a single slip engages and the main body of the torque anchor is pressed against the opposite side of the casing to the engaged slip.

Canadian Patent 2,220,392 describes a torque anchor having a plurality of drag slips that emerge from a slip cage and do not define a fixed volume of space between the slips.

Canadian Patent 2,238,910 describes a torque anchor to prevent right-hand rotation of tubing string within a stationary well casing. The system includes a fixed slip, two floating slips and a means for rotating the slips about the housing to create varying diameters of overall tool.

Canadian Patent 1,274,470 describes a no-turn tool having three movable slips that do not define a fixed volume between the slips.

Otatco Inc. (Calgary, Alberta) produces a torque anchor having a one piece body with integral slips and a collar to prevent right-hand rotation of a tubing string within a stationary well casing. The system includes a no-spring system having collars mounting passive dogs that provide anti-rotation when the collars are counter-rotated with respect to one another.

SUMMARY OF THE INVENTION

Accordingly, there is provided a torque anchor that improves on at least one prior art system.

More specifically, according to certain aspects of the invention, there is provided a torque anchor to prevent rotation of a tubing string within well casing so as to enable operation of a progressive cavity pump and to provide a definable volume of space between the torque anchor and well casing. According to a first aspect of the invention, there is provided a torque anchor to prevent rotation of a tubing string in a first direction while allowing rotation of the tubing string in an opposite second direction. The torque anchor includes a substantially cylindrical body shaped for insertion into a downhole casing of a wellbore; a moveable slip mounted on a periphery of the body, at least a portion of which is moveable outwardly from a central longitudinal axis of the body, wherein the moveable portion moves outwardly into operative contact with the downhole casing when the torque anchor is downhole and the tubing string is rotated in the first direction; at least two rigid slips fixedly coupled to the body, each longitudinally aligned with the longitudinal axis of the body and circumferentially spaced from one another and the moveable slip, the at least two rigid slips dimensioned to permit operative contact with the downhole casing when the torque anchor is downhole and the tubing string is rotated in the first direction; and attachment means for attaching a tube means, preferably a diluent cable, to the body between the at least two rigid slips, the attachment means dimensioned such that when the torque anchor is downhole, the attachment means and tube means are contained within a fixed volume of space defined by the body, the at least two rigid slips, and the downhole casing.

According to another aspect of the invention, there is provided a torque anchor to prevent rotation of a tubing string in a first direction while allowing rotation of the tubing string in an opposite second direction. The torque anchor includes a body shaped for attachment to a tubing string, the body supporting two rigid slips circumferentially spaced from one another at 75-120° to one another on the body for engagement with downhole casing or a well bore; an outwardly biased pivotable slip on the body circumferentially spaced from the at least two rigid slips wherein the pivotable slip is dimensioned to engage with the downhole casing or the well bore when the torque anchor is downhole and when the tubing string is rotated in the first direction, the body including a recess for receiving the pivotable slip when the pivotable slip is biased against the body; and attachment means for attaching a diluent cable to the body between the two rigid slips, the attachment means dimensioned such that when the torque anchor is downhole, the attachment means and diluent cable are contained within a fixed volume of space defined by the body, the two rigid slips, and the downhole casing or the well bore.

According to a further aspect of the invention, there is provided a method for running a tube downhole using a torque anchor configured to prevent rotation of a tubing string in a first direction while allowing rotation of the tubing string in an opposite second direction, and which includes a body shaped for attachment to the tubing string; an outwardly biased moveable slip on the body adapted to contact a downhole casing when the torque anchor is downhole and the tubing string is rotated in the first direction; at least two rigid slips circumferentially spaced from the moveable slip slips wherein the moveable slip is fixedly coupled to the body and dimensioned to operatively contact the downhole casing when the torque anchor is downhole, the at least two rigid slips circumferentially spaced from one another; and attachment means for attaching a diluent cable to the body between the at least two rigid slips, the attachment means dimensioned such that when the torque anchor is downhole, the attachment means and diluent cable are contained within a fixed volume of space defined by the body, the at least two rigid slips, and the downhole casing. The method includes attaching the torque anchor to the tubing string; attaching the tube (preferably a diluent cable) to the torque anchor; inserting the tubing string into a wellbore lined with the downhole casing; running the torque anchor downhole to a setting depth; and setting the torque anchor by applying torque to the tubing string in the first direction.

According to a further aspect of the invention, there is provided a method for running coiled tubing downhole using a torque configured to prevent rotation of a tubing string in a first direction while allowing rotation of the tubing string in an opposite second direction, and which includes a body shaped for attachment to a tubing string; at least one rigid slip fixedly coupled to the body and dimensioned to operatively contact with downhole casing when the torque anchor is downhole; and an outwardly biased pivotable slip on the body circumferentially spaced from the at least one rigid slip wherein the pivotable slip is dimensioned to operatively contact with the downhole casing when the torque anchor is downhole and the tubing string is rotated in the first direction.

BRIEF DESCRIPTION OF THE DRAWINGS

The invention is described by the following detailed description and drawings wherein.

DETAILED DESCRIPTION

In accordance with the invention and with reference to the figures, embodiments of a torque anchor 10 are described.

Figure 1:
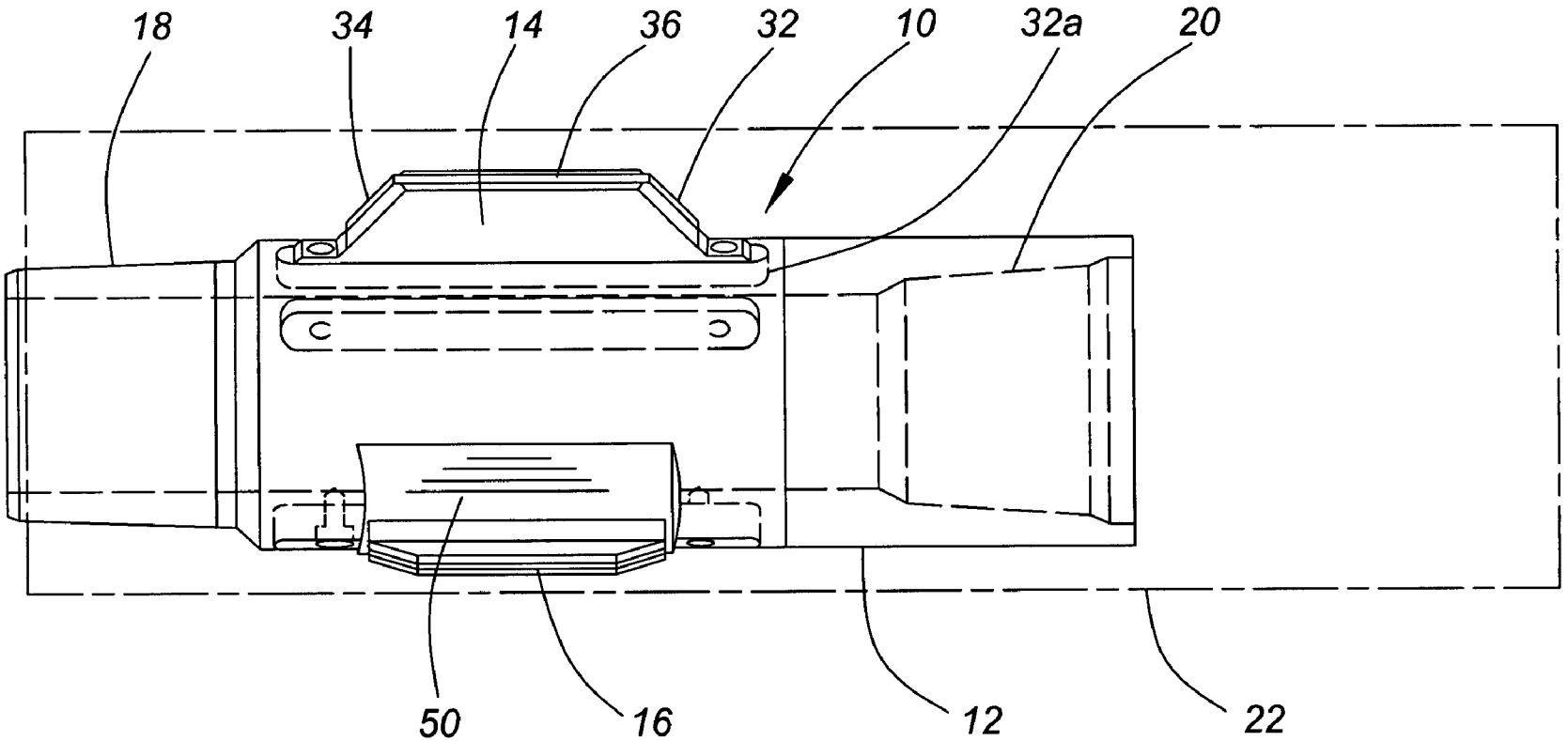
FIG. 1 is a side view of a torque anchor within casing in accordance with one embodiment of the invention.
Figure 2:
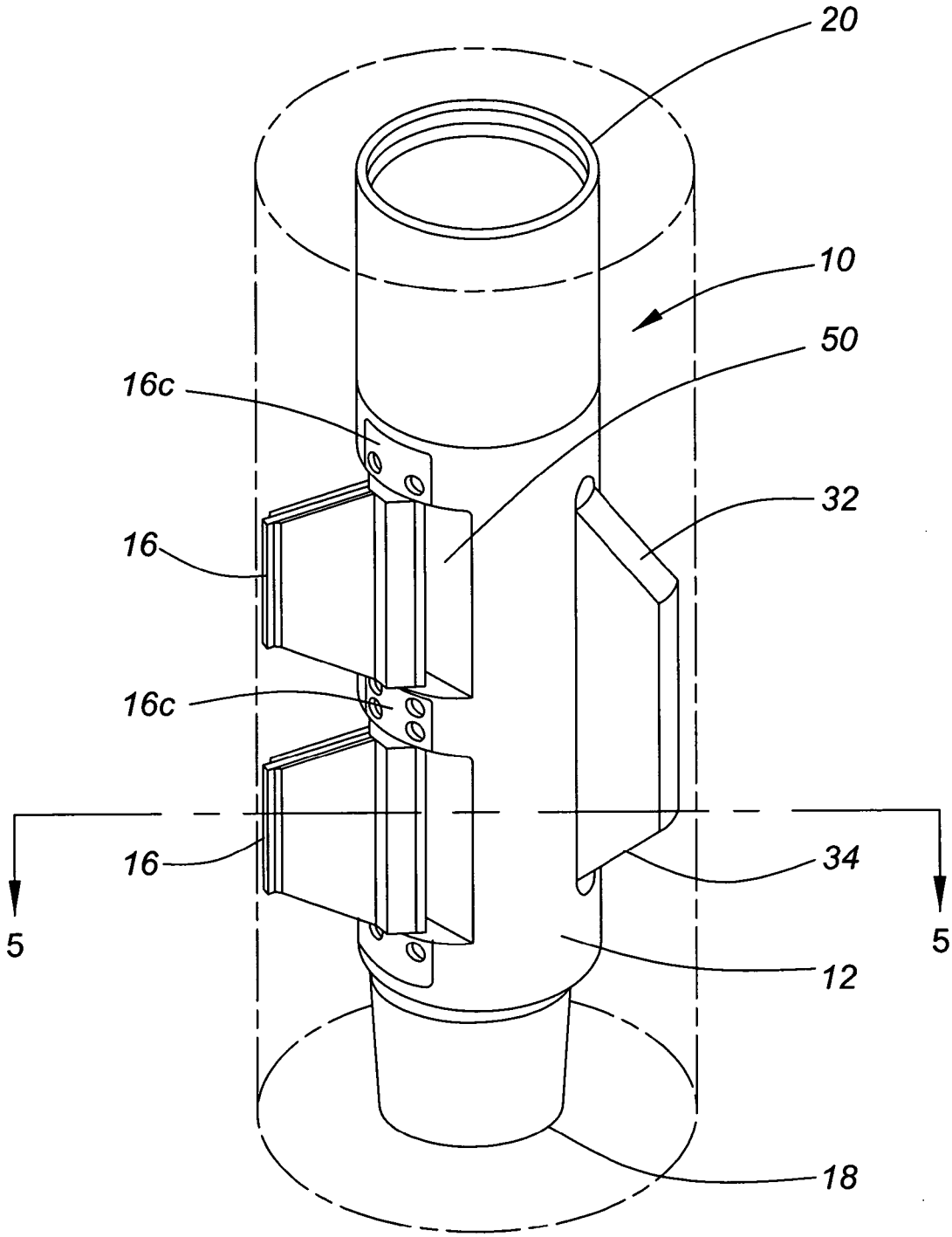
FIG. 2 is a perspective view of a torque anchor within casing in accordance with one embodiment of the invention.
Figure 3:
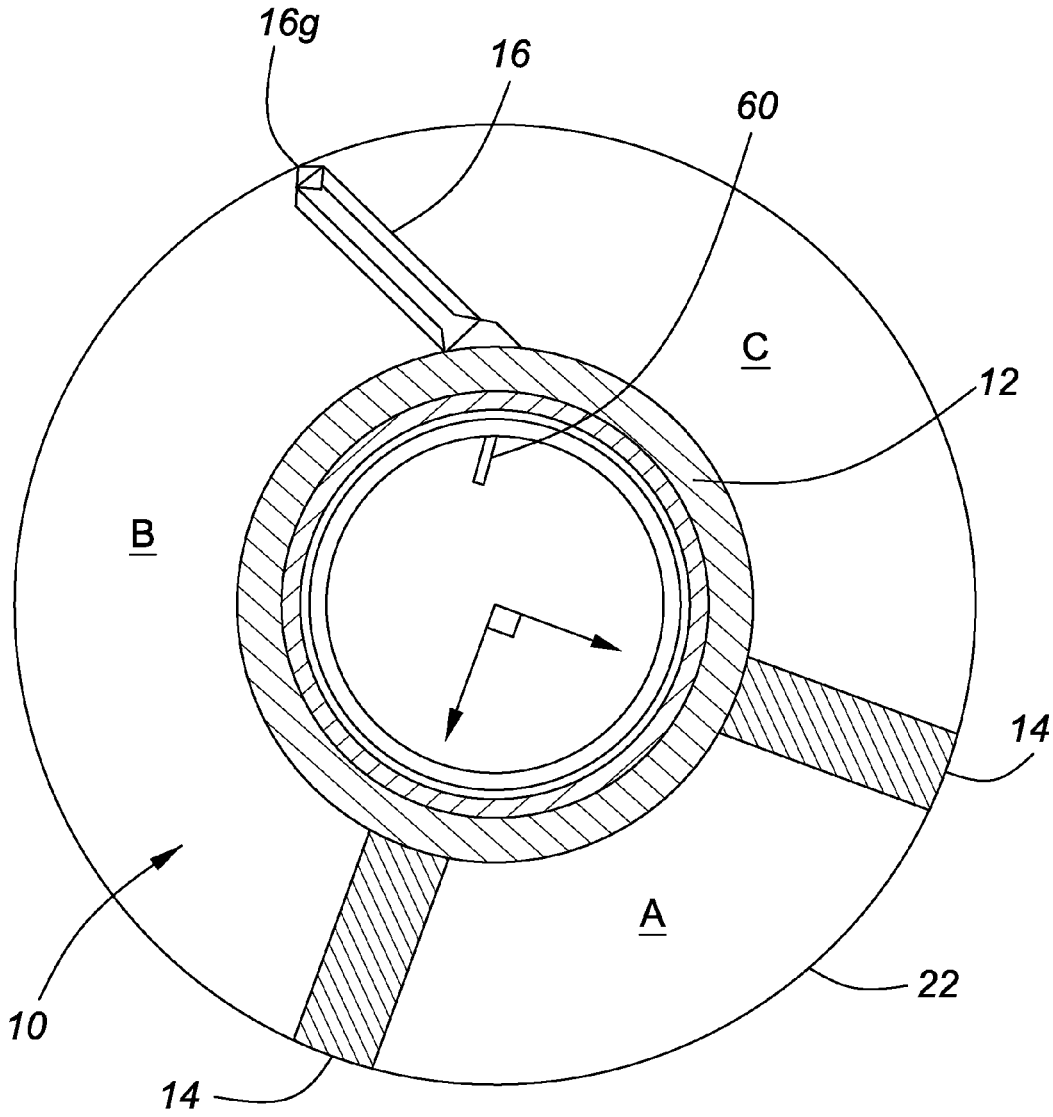
FIG. 3 is a view of a torque anchor within a well casing as viewed from below in accordance with one embodiment of the invention.
Figure 4:
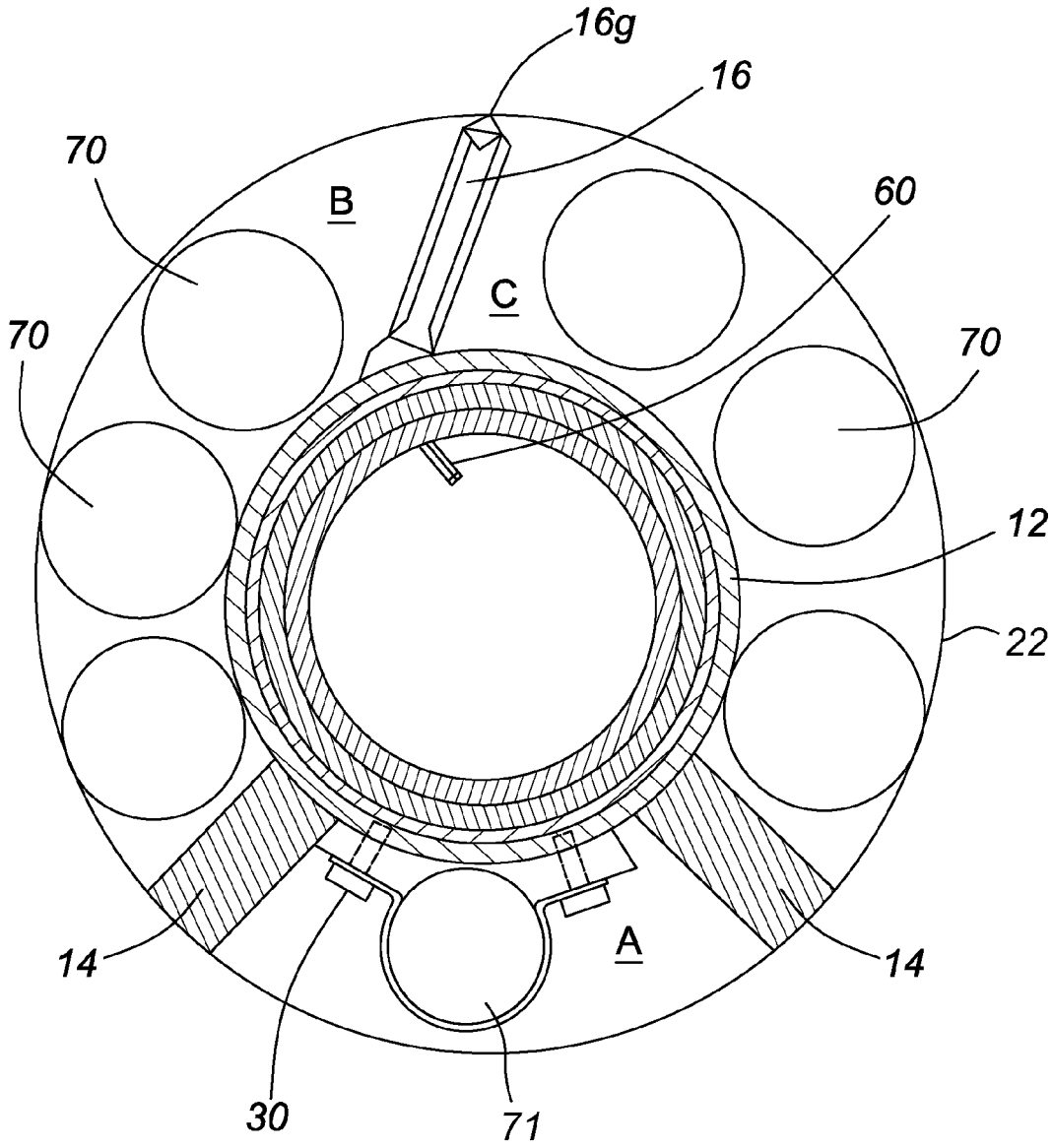
FIG. 4 is a view of a torque anchor centered within a well casing and showing auxiliary tubing as viewed from above in accordance with one embodiment of the invention; and, FIG. 5 is a view of a torque anchor within a well casing and showing auxiliary tubing as viewed from above in accordance with one embodiment of the invention.
Figure 5:
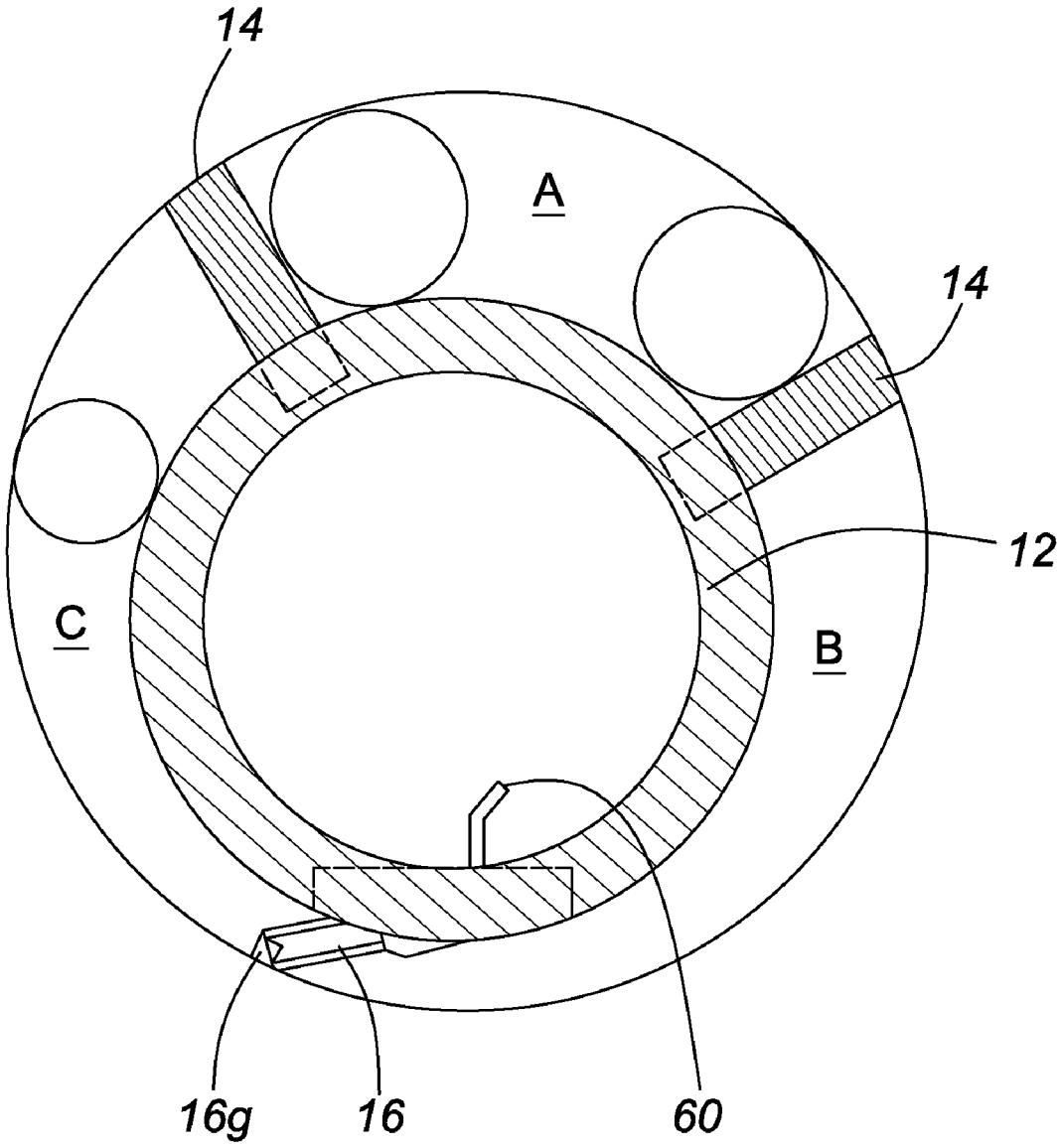

With reference to FIGS. 1-5, embodiments of a torque anchor 10 are shown in two perspective views (FIGS. 1 and 2) and cross-sectional views (FIGS. 3, 4 and 5). The torque anchor generally includes a body 12 on which at least one rigid stabilizing slip, (preferably two) 14 and one outwardly biased and pivotable slip 16 are mounted. The body 12 includes appropriate male 18 and female 20 connectors to allow the torque anchor to be connected to a progressive cavity (PC) pump stator or tubing string (not shown) as known to those skilled in the art.

When mounted to a PC pump stator or tubing string, counter-clockwise rotation (as viewed from above) of the tubing string will permit counter-clockwise rotation of the torque anchor, PC pump and tubing string within well casing 22 (or well bore). Clockwise rotation of the tubing string (as viewed from above) will cause the pivotable slip 16 to engage with the well casing 22 such that the pivotable slip 16 and each of the rigid slips 14 are biased against the well casing 22 (FIGS. 3, 4 and 5). As clockwise torque is maintained on the tubing string, the combination of the rigid slips 14 and pivotable slip 16 prevent clockwise rotation of the torque anchor 10 within the well casing.

As shown in FIGS. 3, 4 and 5, the rigid slips 14 and pivotable slip 16 create three distinct volumes A, B and C between the body and casing. Importantly, volume A is a fixed volume determined by the lateral dimensions and spacing of the fixed slips 14 whereas volumes B and C may vary depending on the inside dimensions of the well casing 22 and outside diameter of the body of the torque anchor 10. Preferably, each of the rigid slips 14 and pivotable slip 16 are dimensioned so as to center the torque anchor body within the casing 22. FIG. 4 shows an embodiment where the slips 14 and 16 are dimensioned to center the tool whereas FIG. 5 shows an embodiment where the body is not centered, but rather positioned to provide even larger volumes A, B and C.

As shown in FIG. 4, where the body is centered, there is a greater capacity to run coiled tubing 70 or diluent cable 71 past the torque anchor 10 within relatively symmetrical volumes B and C. As shown in FIG. 5, where the body is not centered as a result of a smaller lateral dimension of the pivotable slip 16 relative to the lateral dimension of the rigid slips 14, volumes B and C are not symmetrical and, hence, may be able to accommodate different diameters of coiled tubing 70 and diluent cables 71 compared to the system shown in FIG. 4.

Also, as shown in FIG. 4, volume A may be utilized to rigidly attach the diluent cable 71 to the housing through a clamp system 30. Alternatively, the same volume A may be utilized to loosely retain one or more lengths of coiled tubing 70 as shown in FIG. 5.

As shown to varying degrees in FIGS. 3, 4 and 5, the housing diameter may be different relative to the lateral dimension of the slip (as seen in cross-section) and/or the well casing 22 thereby providing different volumes A, B, C for flow of well fluid, sand or other material past the torque anchor 10.

In a preferred embodiment, the rigid slips 14 are mounted on the body 12 parallel to the longitudinal axis of the body at approximately 90 degrees to one another as shown in FIG. 3. This angle may, however, be varied to approximately 75-120 degrees depending on the desired volume A. The rigid slips 14 are attached to the body through an appropriate connection system. It is preferred that the rigid slips 14 are attached using bolts to enable rigid slips 14 of different dimensions to be attached to the body so as to enable an operator to select the most appropriate dimensions for a given casing 22 and in order to create a desired fixed volume A. The rigid slips 14 may be set within a trough 32*a* (FIG. 1) within the body to improve the structural strength of the torque anchor 10. Alternatively, the rigid slips may be permanently fixed to the body by welding. The rigid slips 14 may be a single slip at each circumferential position on the body or may be separate pairs of slips longitudinally separated from one another (not shown). Each rigid slip 14 may be tapered along its upper 32 and lower edge 34 to facilitate vertical movement through the casing in either direction.

The outer surface 36 of the rigid slip 14 may be provided with an appropriate gripping surface to prevent slippage of the torque anchor 10 with respect to the casing 22 when the rigid slips 14 are engaged against the casing, such as a plurality of pointed and hardened ridges. As shown in FIGS. 3, 4 and 5, the pivotable slip 16 may also include a hardened pointed tip 16*g* (preferably tungsten carbide) to enhance the ability of the pivotable slip 16 to grip against casing 22.

Figure 3A:
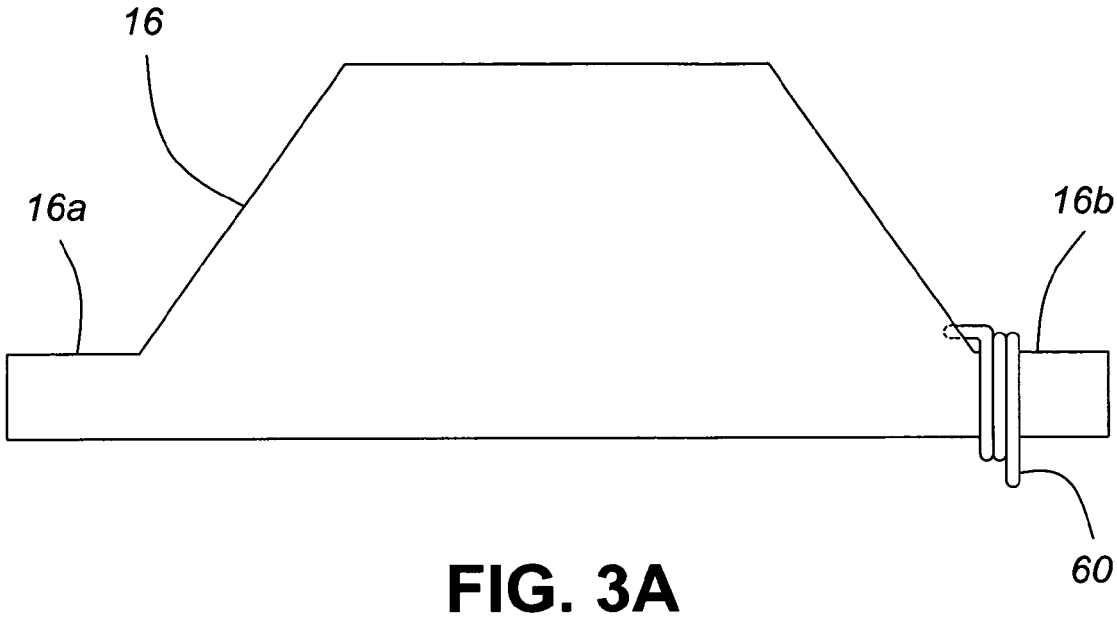
FIG. 3A is a schematic side view of a pivotable slip of a torque anchor in accordance with one embodiment of the invention.
Figure 3B:
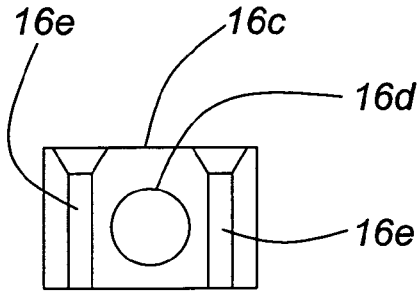
FIG. 3B is a schematic end view of a mounting system for a pivotable slip of a torque anchor in accordance with one embodiment of the invention.

The pivotable slip 16 is pivotally mounted on the housing and is outwardly biased to ensure engagement of the pivotable slip 16 against the casing 22 during clockwise rotation of the torque anchor 10. In the preferred embodiment, the pivotable slip 16 includes two mounting rods 16*a*, 16*b* (FIG. 3A) that are operatively retained within a corresponding mounting system such as lug 16*c* (FIG. 3B). The mounting system or lug includes a bore 16*d* for receiving a mounting rod 16*a*, 16*b*. The mounting system or lug is attached to the body with appropriate bolts within bolt sleeves 16*e*. As shown in FIG. 2, a torque anchor 10 may include two separate pivotable slips 16 longitudinally displaced relative to one another. The pivotable slips 16 may be also tapered along their upper and lower edges to facilitate vertical movement through the casing in either direction.

The pivotable slip 16 may be further attached in the manner as described in Canadian Patent 2,159,659 referred to therein as a pin-actuated slip.

The pivotable slip 16 may be further attached by a collar positioned circumferentially around and attached to the housing (not shown).

In other embodiments, the pivotable slip 16 may be pivotally retained within the body by other means such as but not limited to wedging or camming surfaces, and/or systems utilizing centrifugal force as known to those skilled in the art.

The body 12 may be further provided with a recess 50 to receive the pivotable slip 16 in a fully retracted position.

The pivotable slip 16 is also provided with at least one biasing spring to outwardly bias the pivotable slip 16. The biasing spring is preferably a coil spring 60 (not shown) having a first end for operative contact with the body and a second end for operative contact with the pivotable slip 16. The mounting system may include appropriate recesses such that that the coil spring is not exposed to the outer surfaces of the tool 10.

The pivotable slip 16 may also be removed and an alternate dimension slip attached to the body so as to enable an operator to select the most appropriate dimensions for a given casing 20 and desired use.

Operation

In operation, the torque anchor 10 is threaded on a PC pump stator or on a tubing string above or below a PC pump. The pump and torque anchor 10 are run to the setting depth and torque is applied to the tubing string (right hand direction). The torque anchor 10 is released by rotation in the opposite direction (left hand direction). The torque anchor 10 can either be moved to a different location or pulled from the well.

The torque anchor 10 is an improvement over past torque anchors by providing superior centering capabilities of the PC pump and torque anchor over past torque anchors. As a result, and in combination with the operator's ability to attach rigid slips 14 and pivotable slips 16 of a particular dimension, a known volume of space can be created in a predictable location in a well of any orientation so as to enable auxiliary coiled tubing 70 and/or diluent cables 71 to be run adjacent to the torque anchor 10. Further, the torque anchor 10 provides a generous amount of space for flow of well fluid materials such as sand, than other torque anchors do.

In addition, as contrasted with past torque anchors, the body of the torque anchor 10 can be made smaller than the PC pump stator as only the slips and not the body contact the well casing 22. Also, the operation of the torque anchor 10 does not result in the biasing of the adjacent coiled tubing, diluent cables and tool string against the well bore which can result in extra wear to certain tools such as a PC pump.

Although the present invention has been described and illustrated with respect to preferred embodiments and preferred uses thereof, it is not to be so limited since modifications and changes can be made therein which are within the full, intended scope of the invention.

The invention claimed is:

1. A torque anchor to prevent rotation of a tubing string in a first direction while allowing rotation of the tubing string in an opposite second direction, the torque anchor comprising:

a substantially cylindrical body shaped for insertion into a downhole casing of a wellbore; and a moveable slip mounted on a periphery of the body, at least a portion of said slip being movable outwardly from a central longitudinal axis of the body, wherein the portion moves outwardly into operative contact with the downhole casing when the torque anchor is downhole and the tubing string is rotated in the first direction;

at least two rigid slips fixedly coupled to the body, each of the at least two rigid slips being longitudinally aligned with the longitudinal axis of the body and circumferentially spaced from one another and the moveable slip, the at least two rigid slips dimensioned to permit operative contact with the downhole casing when the torque anchor is downhole and the tubing string is rotated in the first direction; and a connector constructed and adapted to attach a tube to the body between the at least two rigid slips, the connector dimensioned such that when the torque anchor is downhole, the connector and tube are contained within a fixed volume of space defined by the body, the at least two rigid slips, and the downhole casing.

2. A torque anchor as claimed in claim 1 wherein the two rigid slips are detachable from the body.

3. A torque anchor as claimed in claim 1 wherein the two rigid slips are spaced at 75-120° to one another on the body.

4. A torque anchor as claimed in claim 1 wherein the moveable slip is pivotally mounted to the body and is outwardly biased from the body and circumferentially spaced from the at least two rigid slips.

5. A torque anchor as claimed in claim 1 comprising a pair of moveable slips, each longitudinally displaced from each other on the body.

6. A torque anchor as in claim 5 wherein each rigid slip comprises at least two rigid slips longitudinally displaced from one another.

7. A torque anchor as claimed in claim 5 wherein the body includes a recess for receiving the moveable slip when the moveable slip is positioned against the body.

8. A torque anchor as claimed in claim 1 wherein the moveable slip includes a gripping surface for engagement with downhole casing.

9. A torque anchor as in claim 8 wherein the gripping surface is a hardened and pointed tip.

10. A torque anchor as claimed in claim 1 wherein the moveable slip is pivotable about a pin, the pin aligned parallel to the central longitudinal axis of the body.

11. A torque anchor as claimed in claim 1, wherein said tube comprises a diluent cable.

12. A torque anchor as claimed in claim 1 wherein the connector comprises a clamping system fixedly coupled to the body between the at least two rigid slips and configured to receive the tube or diluent cable.

13. A torque anchor as claimed in claim 1 wherein the connector comprises a clamping system fixedly coupled to the body between the at least two rigid slips and configured to receive the tube or diluent cable.

14. A torque anchor as claimed in claim 1 wherein the connector is a means for attaching the tube to the body.

15. A torque anchor to prevent rotation of a tubing string in a first direction while allowing rotation of the tubing string in an opposite second direction, the torque anchor comprising:

a body shaped for attachment to a tubing string, the body supporting two rigid slips fixedly coupled to the body and circumferentially spaced from one another at 75-120° to one another on the body for engagement with downhole casing or a well bore;

an outwardly biased pivotable slip on the body circumferentially spaced from the at least two rigid slips wherein the pivotable slip is dimensioned to engage with the downhole casing or the well bore when the torque anchor is downhole and when the tubing string is rotated in the first direction, the body including a recess for receiving the pivotable slip when the pivotable slip is biased against the body; and a connector constructed and adapted to attach a diluent cable to the body between the two rigid slips, the connector dimensioned such that when the torque anchor is downhole, the connector and diluent cable are contained within a fixed volume of space defined by the body, the two rigid slips, and the downhole casing or the well bore.

16. A torque anchor as claimed in claim 15 wherein each rigid slip comprises first and second rigid slips longitudinally displaced from one another.

17. A torque anchor as claimed in claim 15 wherein the pivotable slip comprises first and second pivotable slips longitudinally displaced from one another.

18. A torque anchor as in claim 15 wherein the rigid slips are detachable.

19. A method for running a tube downhole using a torque anchor configured to prevent rotation of a tubing string in a first direction while allowing rotation of the tubing string in an opposite second direction, the method comprising:

(A) attaching the torque anchor to the tubing string, the torque anchor comprising:

(i) a body shaped for attachment to the tubing string;

(ii) an outwardly biased moveable slip on the body adapted to contact a downhole casing when the torque anchor is downhole and the tubing string is rotated in the first direction, wherein the moveable slip is moveably coupled to the body and dimensioned to operatively contact the downhole casing when the torque anchor is downhole;

(iii) at least two rigid slips fixedly coupled to the body and circumferentially spaced from the moveable slip, the at least two rigid slips circumferentially spaced from one another; and (iv) a connector constructed and adapted to attach the tube to the body between the at least two rigid slips, the connector dimensioned such that when the torque anchor is downhole, the connector and tube are contained within a fixed volume of space defined by the body, the at least two rigid slips, and the downhole casing;

(B) attaching the tube to the torque anchor;

(C) inserting the tubing string into a wellbore lined with the downhole casing;

(D) running the torque anchor downhole to a setting depth; and (E) setting the torque anchor by applying torque to the tubing string in the first direction.

20. A method as claimed in claim 19, wherein said tube is a diluent cable.

21. A method as claimed in claim 19 wherein the connector comprises a clamping system fixedly coupled to the body between the at least two rigid slips and configured to receive the diluent cable.

22. A method as claimed in claim 19 further comprising inserting coiled tubing down the wellbore such that said coiled tubing travels through the fixed volume of space.

23. A method as claimed in claim 19 further comprising inserting coiled tubing down the wellbore such that it travels through a second volume of space defined by the body, either of the rigid slips, the downhole casing, and the moveable slip.

24. A method for running coiled tubing downhole, the method comprising:

(A) attaching, to a tubing string, a torque anchor configured to prevent rotation of a tubing string in a first direction while allowing rotation of the tubing string in an opposite second direction, the torque anchor comprising:

(i) a body shaped for attachment to a tubing string;

(ii) at least two rigid slips fixedly coupled to the body and dimensioned to operatively contact with downhole casing when the torque anchor is downhole; and (iii) an outwardly biased pivotable slip on the body circumferentially spaced from the at least one rigid slip wherein the pivotable slip is dimensioned to operatively contact with the downhole casing when the torque anchor is downhole and the tubing string is rotated in the first direction; and (iv) a connector constructed and adapted to attach tubing to the body between the at least two rigid slips (B) inserting the tubing string into a wellbore lined with the downhole casing;

(C) running the torque anchor downhole to a setting depth;

(D) setting the torque anchor by applying torque to the tubing string in the first direction such that a volume of space is created between the body and the downhole casing; and (E) inserting coiled tubing down the wellbore such that it travels through the volume of space.

25. A method as claimed in claim 24 wherein the at least two rigid slips comprise at least two rigid slips circumferentially spaced from one another and wherein the volume of space comprises a fixed volume of space defined by the body, the at least two rigid slips, and the downhole casing.

26. A method as claimed in claim 24 wherein the volume of space comprises a known volume of space defined by the body, the at least two rigid slips, the downhole casing, and the pivotable slip.

27. A method as claimed in claim 24 wherein the at least two rigid slips comprises at least two rigid slips circumferentially spaced from one another and wherein the volume of space comprises:

a fixed volume of space defined by the body, the at least two rigid slips, and the downhole casing; and a second volume of space defined by the body, the at least two rigid slips, the downhole casing, and the pivotable slip.

* * * * *